US006029583A

United States Patent [19]

LeTrudet

[11] Patent Number: 6,029,583

[45] **Date of Patent: *Feb. 29, 2000**

[54] PALLET WITH ATTACHABLE UPPER AND LOWER MEMBERS

[75] Inventor: Stephane F. LeTrudet, St. Charles, Mo.

[73] Assignee: Allibert-Contico, L.L.C., St. Louis, Mo.

[ * ] Notice: Under 35 U.S.C. 154(b), the term of this patent shall be extended for 632 days.

[21] Appl. No.: 08/674,667

[22] Filed: Jul. 2, 1996

[51] Int. Cl.[7] ..... B65D 19/00

[52] U.S. Cl. ..... 108/57.25; 108/57.26

[58] Field of Search ..... 108/53.3, 56.3, 108/56.1, 901, 902, 51.1, 57.25, 57.26

[56] References Cited

U.S. PATENT DOCUMENTS

| | | | |
|---|---|---|---|
| 3,307,504 | 3/1967 | Cloyd et al. . | |
| 3,696,761 | 10/1972 | Brown . | |
| 3,699,901 | 10/1972 | Cook, III . | |
| 3,824,933 | 7/1974 | Lind . | |
| 4,051,787 | 10/1977 | Nishitani et al. . | |
| 4,428,306 | 1/1984 | Dresen et al. | 108/901 X |
| 4,799,433 | 1/1989 | Luft | 108/56.1 X |
| 4,838,176 | 6/1989 | Bowser, Sr. et al. | 108/901 X |
| 5,094,175 | 3/1992 | Christie | 108/901 X |
| 5,176,465 | 1/1993 | Holsted . | |
| 5,367,961 | 11/1994 | Arai et al. . | |
| 5,483,899 | 1/1996 | Christie | 108/56.3 |
| 5,497,709 | 3/1996 | Gonzalez et al. | 108/56.3 |
| 5,527,585 | 6/1996 | Needham et al. | 108/901 X |

FOREIGN PATENT DOCUMENTS

| | | | |
|---|---|---|---|
| 2101346 | 3/1972 | France | 108/902 |

*Primary Examiner*—Jose V. Chen
*Attorney, Agent, or Firm*—Howell & Haferkamp, LC

[57] ABSTRACT

A pallet comprising a lower member and an upper member. The lower member includes a base, a plurality of protrusions extending upwardly from the base, and a plurality of holding fingers extending laterally from the protrusions. The upper member is configured for attachment to the lower member. The upper member includes a deck and a plurality of legs extending down from the deck. Each leg has at least one side wall and a notch in the side wall engageable with one of the laterally extending holding fingers of the lower member. The legs are sized and configured to space the deck of the upper member above the base of the lower member when the upper member is attached to the lower member to define tine-receiving channels between the deck and base for receiving the tines of a fork-lift truck. The upper and lower members are configured so that when the upper member is attached to the lower member, then the laterally extending holding fingers engage the notches in the leg side walls of the upper member to secure the upper member to the lower member.

23 Claims, 5 Drawing Sheets

PALLET WITH ATTACHABLE UPPER AND LOWER MEMBERS

BACKGROUND OF THE INVENTION

This invention relates generally to pallets and more particularly to pallets having an upper member attached to a lower member.

Many load bearing pallets of the type used with fork lift trucks are made of plastic. Such pallets often have upper faces, lower faces, and spacers separating the upper and lower faces to enable the tines of a fork lift to be inserted between the faces. Several of these pallets are of two-piece constructions and include upper and lower members. When not in use, the respective members of a plurality of pallets may be nested together to minimize the space required for storage. Before use, an upper member is attached to the lower member with screw-type fasteners or other suitable fasteners.

A disadvantage of such pallets is that fastening the upper and lower members together is time consuming. Also, if the fasteners become lose or if they are not adequately tightened in the beginning, then the strength and reliability of the assembled pallet is diminished. Another disadvantage is that the fasteners alone prevent separation of the upper and lower members. During use of the pallet, the fasteners are often subject to shearing forces. Failure of the fasteners reduce the strength and durability of the pallet.

SUMMARY OF THE INVENTION

Among the several objects of the present invention may be noted the provision of an improved pallet; the provision of such a pallet having upper and lower members which may be easily and quickly connected together; the provision of such a pallet which is configured to minimize operator error in connecting the upper member to the lower member; the provision of such a pallet which is configured to resist separation of the upper and lower members; the provision of such a pallet which is strong, lightweight, and of relatively simple construction.

In general, a pallet of the present invention comprises a lower member and an upper member. The lower member includes a base, a plurality of protrusions extending upwardly from the base, and a plurality of holding fingers extending laterally from the protrusions. The base, protrusions and holding fingers are of a single unitary piece. The upper member is configured for attachment to the lower member. The upper member includes a deck and a plurality of legs extending down from the deck. Each leg has at least one side wall and a notch in the side wall engageable with one of the laterally extending holding fingers of the lower member. The legs are sized and configured to space the deck of the upper member above the base of the lower member when the upper member is attached to the lower member to define tine-receiving channels between the deck and base for receiving the tines of a fork-lift truck. The deck and the legs are of a single unitary piece. The upper and lower members are configured so that when the upper member is attached to the lower member, then the laterally extending holding fingers engage the notches in the leg side walls of the upper member to secure the upper member to the lower member.

In another aspect of the present invention, at least two holding fingers extend laterally from each protrusion in generally opposite directions. The upper and lower members are configured so that when the upper member is attached to the lower member, then each protrusion is positioned between opposing side walls of a pair of the legs of the upper member, and the holding fingers associated with the protrusion engage the notches in the opposing side walls to secure the upper member to the lower member.

In yet another aspect of the present invention, the lower member includes a plurality of leg-receiving sockets. When the upper member is attached to the lower member, then the laterally extending holding fingers engage the notches in the leg side walls of the upper member to limit vertical movement of the upper member relative to the lower member and portions of the legs are received in the sockets. The sockets are configured for limiting lateral movement of the upper member relative to the lower member when the legs are received in the sockets.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
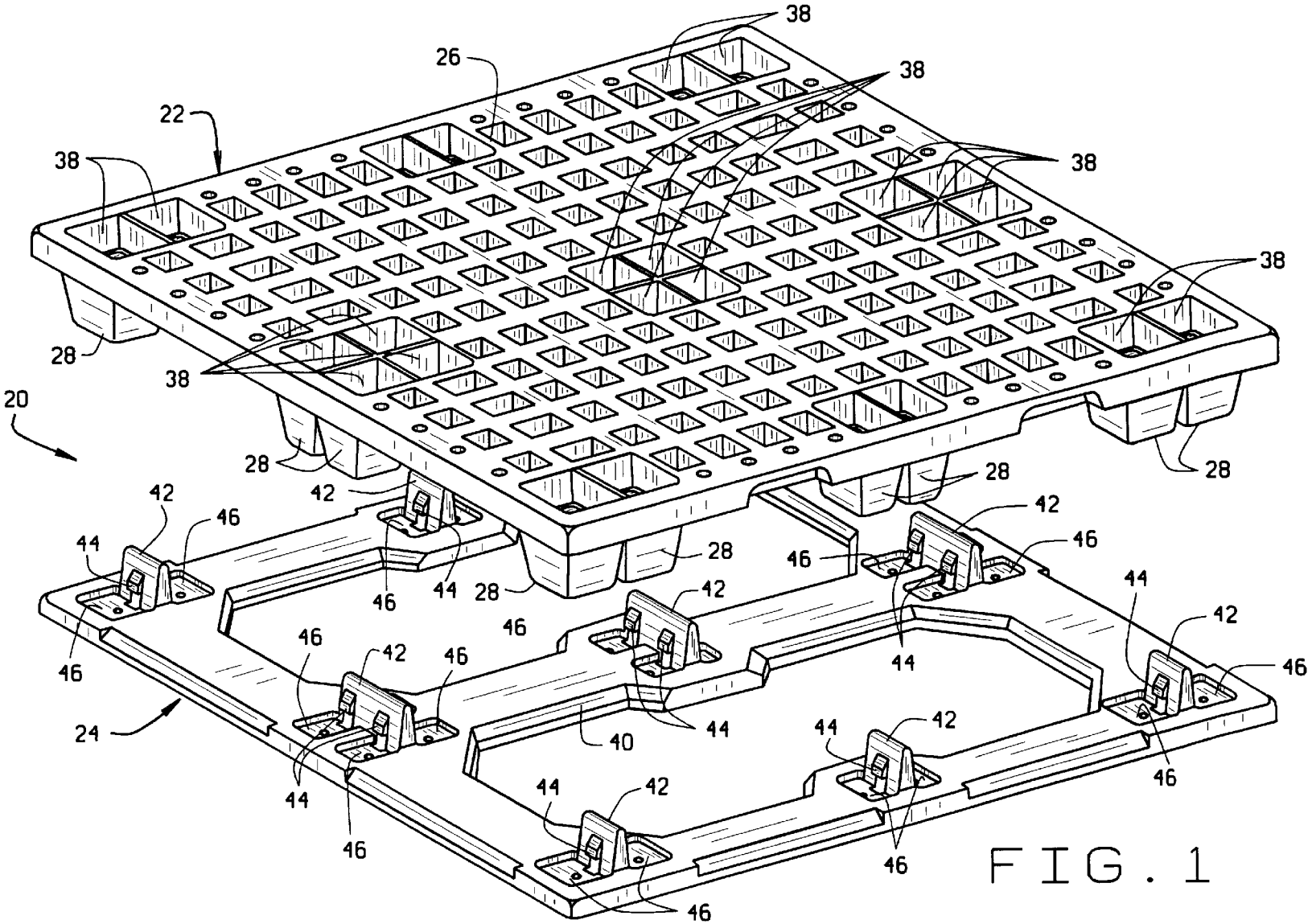
FIG. 1 is an exploded perspective view of a pallet of the present invention having a lower member and an upper member.

Referring now to the drawings, a pallet of the present invention is indicated in its entirety by the reference numeral 20. The pallet 20 includes an upper member, generally indicated at 22, and a lower member, generally indicated at 24. As discussed below, the upper and lower members 22, 24 are configured for a snap-fit connection with each other. Preferably, the upper and lower members 22, 24 are of a suitable injection molded polymeric material, such as high density polyethylene (HDPE). Alternatively, the upper and lower members 22, 24 may be of structural foam.

The upper member 22 includes a deck 26 and a plurality of legs 28 extending down from the deck. Although the underside of the deck 26 is not shown, it is to be understood that the upper member 22 is formed with the deck having a plurality of reinforcing ribs of any conventional pattern to resist bending and twisting of the upper member during use of the pallet 20. Also, although the top surface of the deck 26 is shown as having a particular grid pattern, it is to be understand that the deck could alternatively have any other type of surface configuration without departing from the scope of this invention. For example, the deck surface could alternatively be smooth, or could be covered with non-slip strips.

Figure 2:
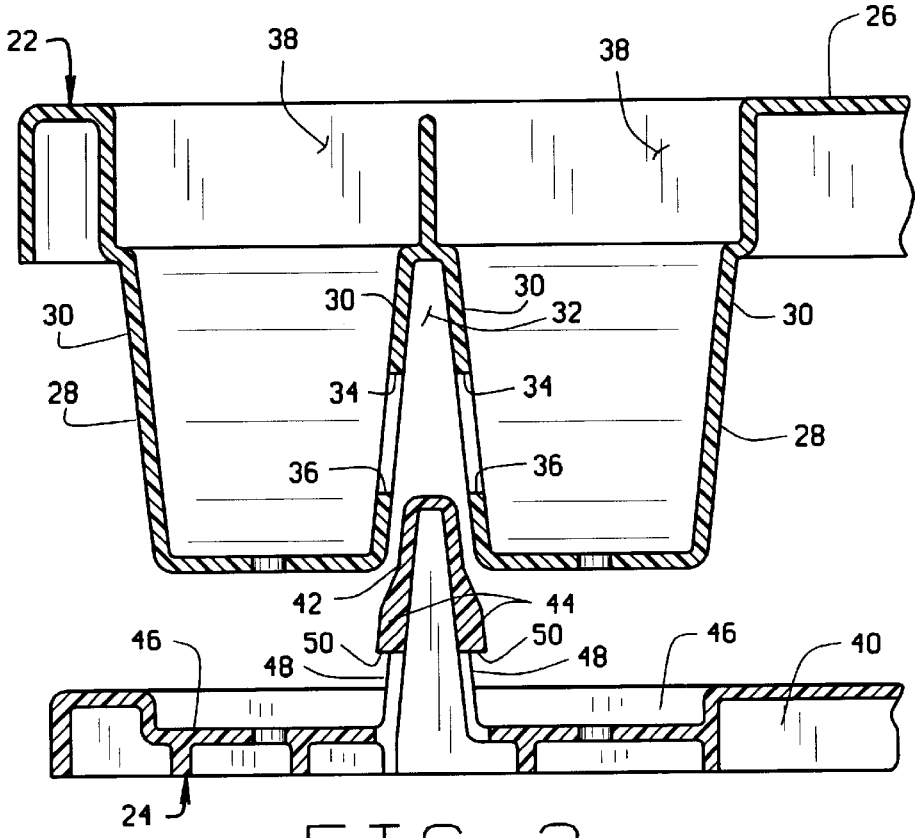
FIG. 2 is an exploded, fragmented, side elevational view, in section, of the pallet of FIG. 1.
Figure 3:
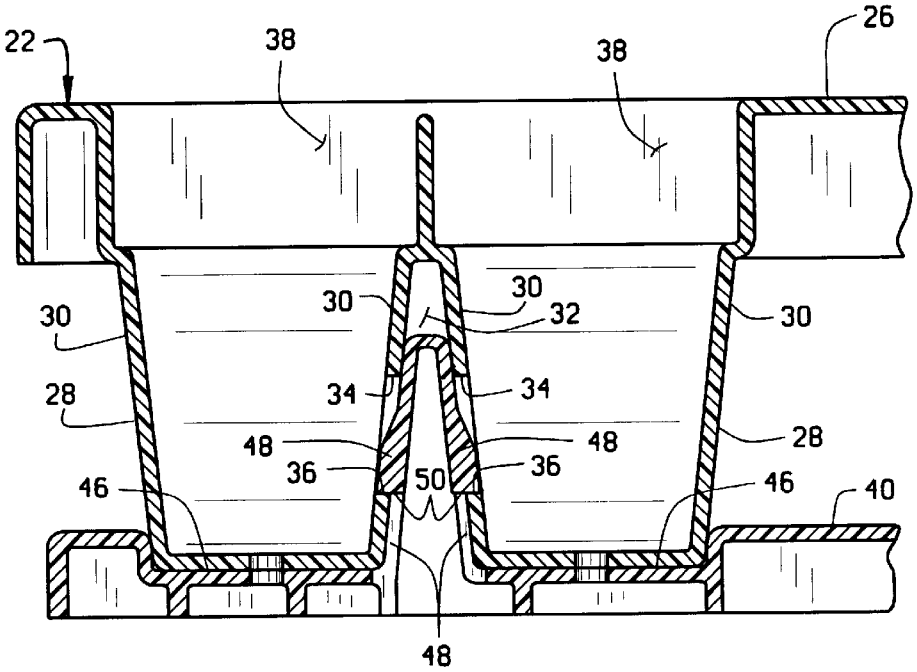
FIG. 3 is a fragmented, side elevational view, in section, of the pallet of FIG. 1 showing the upper member connected to the lower member.
Figure 4:
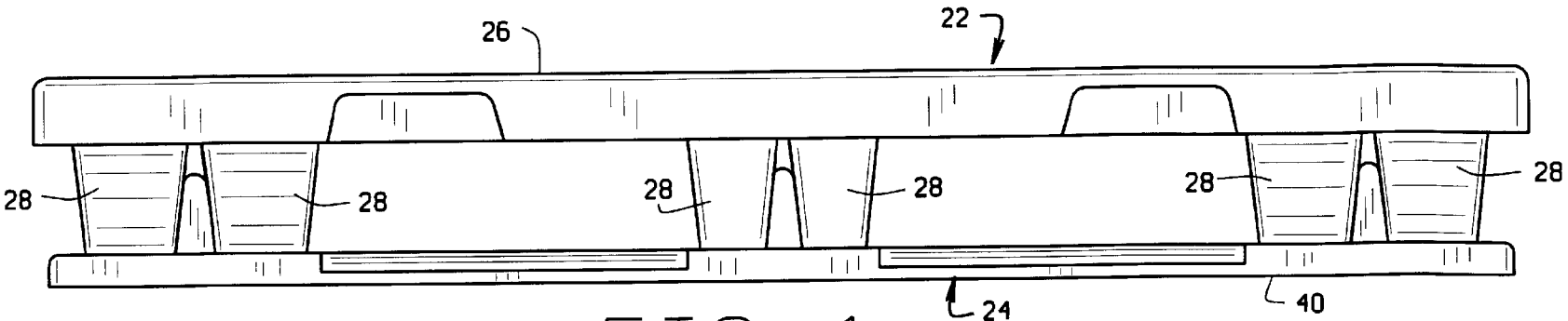
FIG. 4 is a side elevational view of the pallet of FIG. 1.
Figure 5:
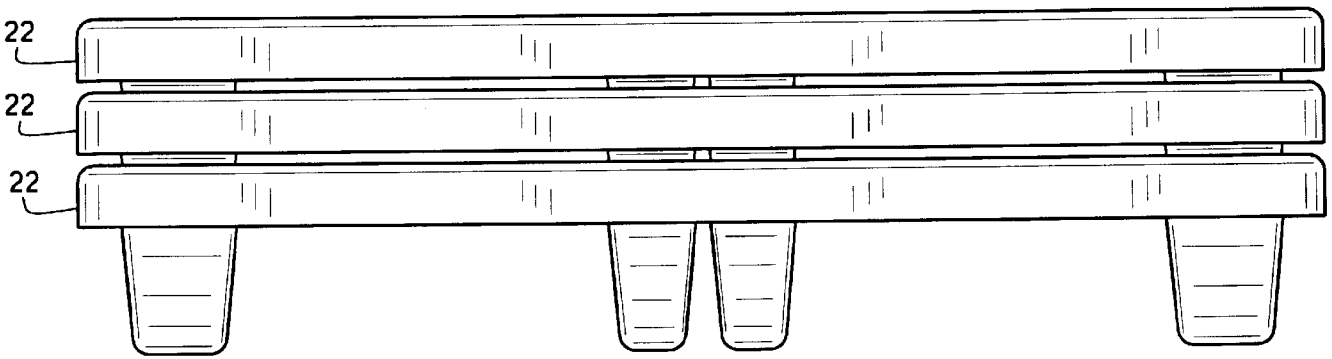
FIG. 5 is a side elevational view of a plurality of nested upper members, each upper member being identical to the upper member of the pallet of FIG. 1.

Preferably, each leg 28 is formed of a plurality (e.g., four) of side walls 30 (FIGS. 2 and 3) which converge inwardly from top to bottom so that the leg tapers from top to bottom. Also preferably, the legs 28 extend downwardly from the base in adjacent pairs. The opposing side walls 30 of each adjacent pair of legs 28 define a protrusion receiving gap 32 (FIG. 2), the purpose of which is described in greater detail below. The opposing side walls 30 also have opposing openings 34 therein, the lower edges of the openings constituting notches 36 (i.e., upwardly facing surfaces) of the side walls. The deck 26 also has leg-receiving openings 38 therethrough in alignment with the hollow insides of the legs 28 for receiving the legs of another identical upper member. Because of the leg-receiving openings 38 and because the legs 28 taper downwardly from the deck 26, a plurality of identical upper members 22 may be nested together when the lower member 24 is not connected to the upper member to minimize the space required for storage thereof. FIG. 5 shows a plurality of nested upper members 22.

The lower member 24 includes a base 40 and a plurality of protrusions 42 (preferably nine) extending upwardly from the base. Although the underside of the base 40 is not shown, it is to be understood that the lower member 24 is formed with the base having a plurality of reinforcing ribs of any conventional pattern to resist bending and twisting of the base 40. A plurality of holding fingers 44 extend laterally from the protrusions 42. Preferably, at least two of such holding fingers 44 extend laterally from each protrusion 42 in generally opposite directions. The base 40 of the lower member 24 includes a plurality of sockets 46, each socket being shaped and configured for receiving a lower portion of at least one leg 28 when the upper member 22 is connected to the lower member. The base 40, protrusions 42 and holding fingers 44 comprise a single unitary (monolithic) piece.

Figure 6:
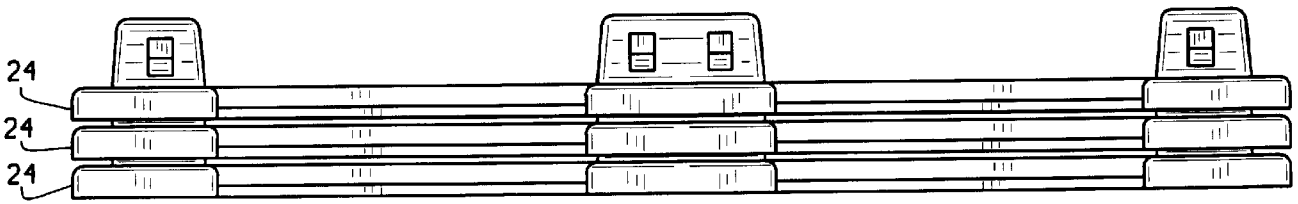
FIG. 6 is a side elevational view of a plurality of nested lower members, each lower member being identical to the lower member of the pallet of FIG. 1.

Preferably, the protrusions 42 are hollow and are configured to enable a plurality of identical upper members 22 to be nested together to minimize the space required for storage thereof. In particular, the protrusions 42 include through openings 48 under their associated holding fingers 44 to receive the holding fingers of another lower member nested thereunder. FIG. 6 shows a plurality of nested lower members 24.

Referring again to FIGS. 2 and 3, the upper and lower members 22, 24 are configured for snap engagement of the laterally extending holding fingers 44 with the notches 36 of the side walls 30. Preferably, the holding fingers 44 are generally wedge shaped for urging the legs 28 outwardly relative to the holding fingers as the legs are inserted into the sockets 46. Also, the holding fingers 44 have downwardly facing shoulders 50 engageable with the notches 36 in the leg side walls 30 to interfere with separation of the upper member 22 from the lower member.

Figure 7:
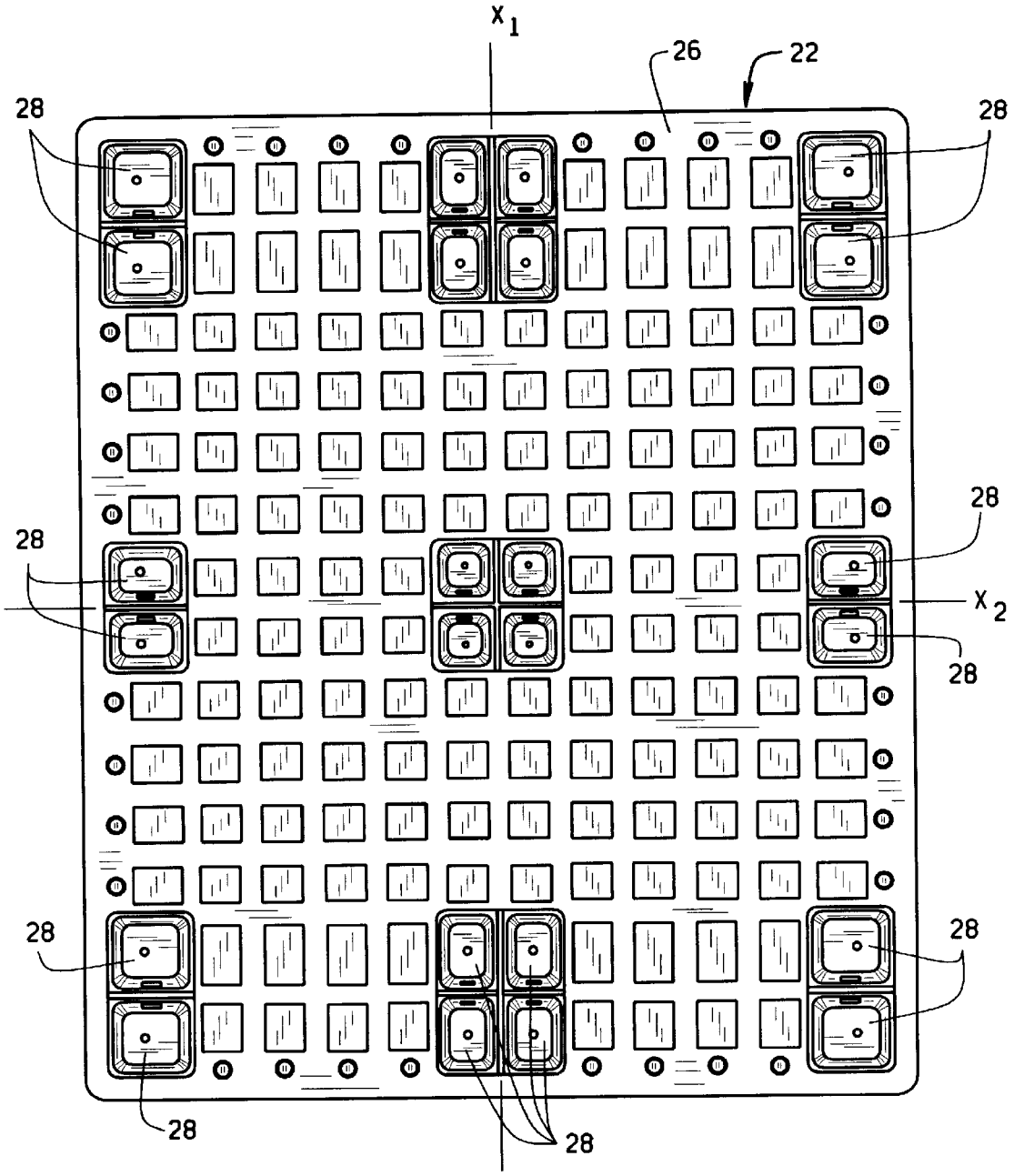
FIG. 7 is a top plan view of the upper member of the pallet of FIG. 1.

To secure the upper and lower members 22, 24 together, a user places the lower member 24 on a floor and then places the upper member 22 over the lower member so that the protrusion receiving gaps 32 of the upper member align with the protrusions 42 of the lower member. As shown in FIG. 7, the upper member 22 is preferably symmetrical about vertical planes $X_1$, $X_2$ parallel to and equally spaced between opposite edges of the upper member so that the upper member can be connected to the lower member even if the upper member is rotated 180°. After the upper and lower members 22, 24 are aligned, the user then pushes the upper member downwardly against the lower member. As the upper member 22 moves downwardly, the wedge-shaped holding fingers 44 push against the opposing side walls 30 of the legs 28 to resiliently urge the legs outwardly (i.e., toward the side margins of the drawings as viewed in FIG. 2). When the holding fingers 44 align with the opposing openings 34 of the side walls 30, then the side walls snap inwardly back to their relaxed positions and the holding fingers extend into the opposing openings 34. The downwardly facing shoulders 50 of the holding fingers 44 engage the notches 36 of the leg side walls 30 to secure the upper member 22 to the lower member. Preferably, the protrusion receiving gaps 32 and the protrusions 42 are sized and configured for a close fit of the holding fingers 44 in the openings 34 to minimize play (i.e., movement) of the upper member 22 relative to the lower member 24. The leg-receiving sockets 46 of the base 40 are sized for a close fit of the legs 28 therein to minimize lateral play of the legs in the sockets. Engagement of the holding fingers 44 with the notches 36 and engagement of the legs 28 in the sockets 46, cooperate to provide a durable, sturdy pallet 20 which resists twisting and bending.

Figure 8:
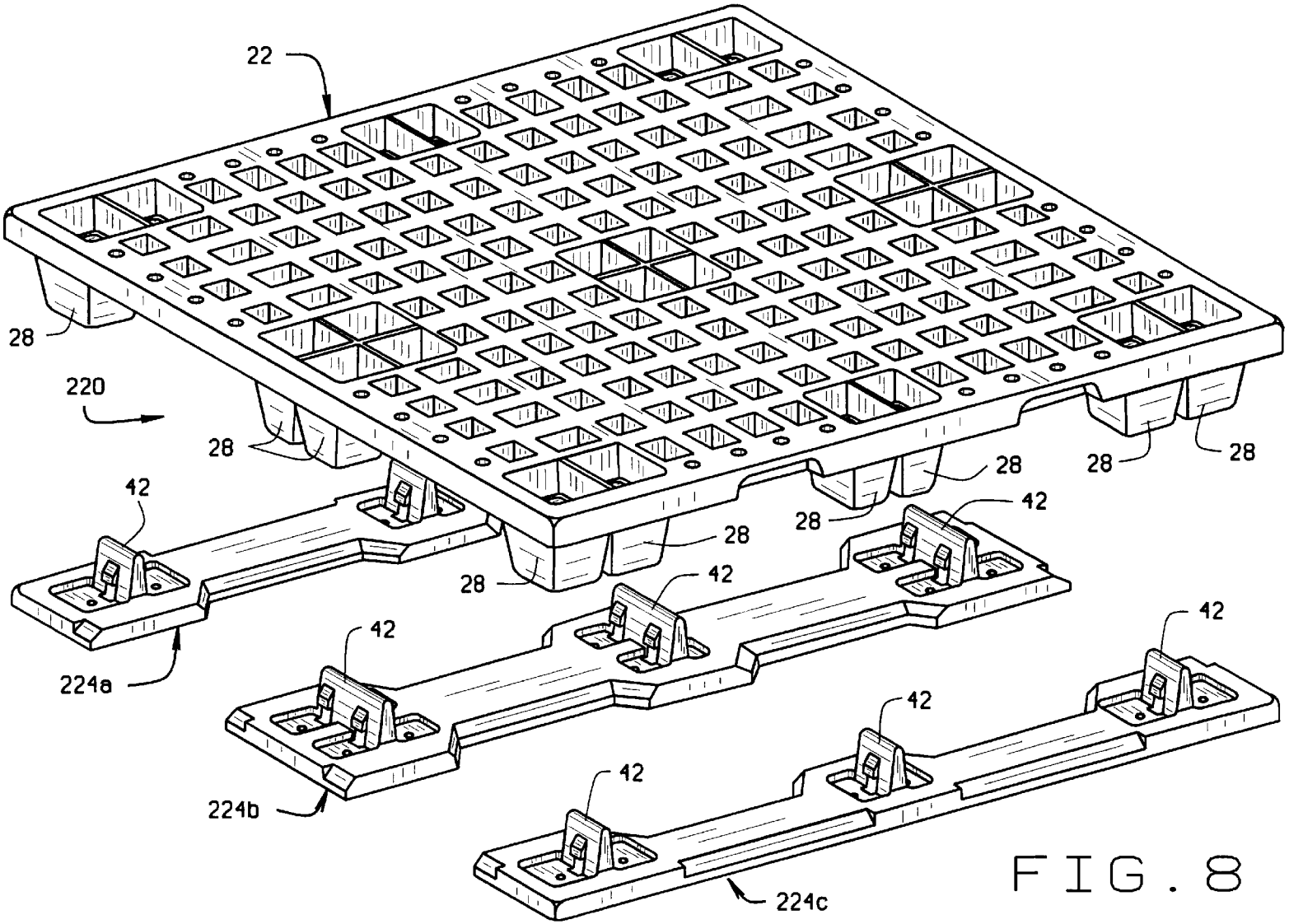
FIG. 8 is an exploded perspective view of another pallet of the present invention, similar to the pallet of FIG. 1 but having a based formed by three smaller lower members.

Referring now to FIG. 8, a second embodiment of a pallet of the present invention is indicated in its entirety by the reference numeral 220. The only difference between the pallet 220 of FIG. 8 and the pallet 20 of FIG. 1 is that the pallet 220 has first, second and third lower members 224*a*, 224*b*, 224*c*. The first, second, and third lower members 224*a*, 224*b*, 224*c* combine to provide support to the pallet 220 in substantially the same manner as the lower member 24 of the pallet 20. The lower members 224*a*, 224*b*, 224*c* include protrusions 42, holding fingers 44, and sockets 46 identical to those of the lower member 24 of the pallet 20. Thus, the detailed description of the lower member 24 of the pallet 20 and its attachment to the upper member 22 is equally applicable to that of the lower members 224*a*, 224*b*, 224*c*.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. It is intended that the invention shall be limited solely by the scope of the claims.

What is claimed is:

1. A pallet comprising:

a lower member including a base, a plurality of protrusions extending upwardly from the base, and a plurality of holding fingers extending laterally from the protrusions, the base, protrusions and holding fingers comprising a single unitary piece; and an upper member configured for attachment to the lower member, the upper member including a deck and a plurality of legs extending down from the deck, each leg having at least one side wall and a notch in the side wall engageable with one of the laterally extending holding fingers of the lower member, the legs being sized and configured to space the deck of the upper member above the base of the lower member when the upper member is attached to the lower member to define tine-receiving channels between the deck and base for receiving the tines of a fork-lift truck, the deck and the legs comprising a single unitary piece;

the upper and lower members being configured so that when the upper member is attached to the lower member, then the laterally extending holding fingers engage the notches in the leg side walls of the upper member to secure the upper member to the lower member.

2. A pallet as set forth in claim 1 wherein the upper and lower members are configured for snap engagement of the laterally extending holding fingers with the notches of the side walls.

3. A pallet as set forth in claim 1 wherein each notch defines an opening through its associated side wall.

4. A pallet as set forth in claim 1 wherein the legs are generally hollow and taper downwardly from the deck of the upper member so that the legs of the upper member are nestable with legs of another member identical to the upper member when the lower member is not connected to the upper member.

5. A pallet as set forth in claim 1 wherein the base of the lower member includes a plurality of sockets, each socket being configured for receiving a lower portion of at least one leg when the upper member is connected to the lower member.

6. A pallet as set forth in claim 1 wherein two of said holding fingers extend oppositely from each of the protrusions, and wherein the plurality of legs comprise a plurality of pairs of adjacent legs, the oppositely extending holding fingers associated with each protrusion being configured for engaging the notches of one of the pairs of adjacent legs when the upper member is connected to the lower member.

7. A pallet as set forth in claim 6 wherein the base of the lower member includes a plurality of sockets, each socket being configured for receiving a lower portion of at least one leg when the upper member is connected to the lower member.

8. A pallet as set forth in claim 7 wherein the holding fingers are generally wedge shaped for urging the legs outwardly relative to the holding fingers as the legs are inserted into the sockets, said holding fingers having shoulders engageable with the notches in the leg side walls to interfere with separation of the upper member from the lower member.

9. A pallet as set forth in claim 1 wherein said lower member constitutes a first lower member, said pallet further comprising:

a second lower member, said second lower member including a second base, a second plurality of protrusions extending upwardly from the second base, and a second plurality of holding fingers extending laterally from said second plurality of protrusions;

the upper member and said first and second lower members being configured so that when the upper member is attached to the lower members, then the laterally extending holding fingers of said first and second lower members engage the notches in the leg side walls of the upper member to limit vertical movement of the upper member relative to the first and second lower members.

10. A pallet comprising:

a lower member including a base, a plurality of protrusions extending upwardly from the base, and a plurality of holding fingers, at least two of such holding fingers extending laterally from each protrusion in generally opposite directions; and an upper member configured for attachment to the lower member, the upper member including a deck and a plurality of legs extending down from the deck, each leg having at least one side wall and a notch in the side wall engageable with one of the holding fingers of the lower member, the legs being sized and configured to space the deck of the upper member above the base of the lower member when the upper member is attached to the lower member to define tine-receiving channels between the deck and base for receiving the tines of a fork-lift truck;

the upper and lower members being configured so that when the upper member is attached to the lower member, then each protrusion is positioned between opposing side walls of a pair of said legs and the holding fingers associated with said each protrusion engage the notches in said opposing side walls to limit vertical movement of the upper member relative to the lower member.

11. A pallet as set forth in claim 10 wherein the base of the lower member includes a plurality of sockets, each socket being configured for receiving a lower portion of at least one of the legs of the upper member when the upper member is connected to the lower member, said sockets being engageable with the legs of the upper member to limit lateral movement of the upper member relative to the lower member.

12. A pallet as set forth in claim 11 wherein said notches define openings through the leg side walls, said holding fingers being configured so that portions thereof extend into said openings when the upper member is attached to the lower member.

13. A pallet as set forth in claim 12 wherein the holding fingers are generally wedge shaped for urging said opposing side walls of said pair of legs laterally outwardly relative to the protrusions as the legs are inserted into the sockets, said holding fingers having shoulders engageable with the notches in the leg side walls to interfere with separation of the upper member from the lower member when the holding fingers are in alignment with said openings.

14. A pallet as set forth in claim 13 wherein said legs and holding fingers are configured for a snap engagement of the holding fingers with the notches in the leg side walls.

15. A pallet as set forth in claim 10 wherein the legs are generally hollow and taper downwardly from the deck of the upper member so that the legs of the upper member are nestable with legs of another member identical to the upper member when the lower member is not connected to the upper member.

16. A pallet as set forth in claim 10 wherein the protrusions are generally hollow and taper upwardly from the base of the lower member so that the protrusions of the lower member are nestable with protrusions of another member identical to the lower member when the lower member is not connected to the upper member.

17. A pallet as set forth in claim 10 wherein the base, protrusions and fingers comprise a first single unitary piece, and wherein the deck and the legs comprise a second single unitary piece.

18. A pallet as set forth in claim 10 wherein the lower member has a width and length approximately equal to the width and length of the upper member.

19. A pallet comprising:

a lower member including a base, a plurality of protrusions extending upwardly from the base, a plurality of holding fingers, and a plurality of leg-receiving sockets, at least one of such holding fingers extending laterally from each protrusion; and an upper member configured for attachment to the lower member, the upper member including a deck and a plurality of legs extending down from the deck, each leg having at least one side wall and a notch in the side wall engageable with one of the holding fingers of the lower member, the legs being sized and configured to space the deck of the upper member above the base of the lower member when the upper member is attached to the lower member to define tine-receiving channels between the deck and base for receiving the tines of a fork-lift truck;

the upper and lower members being configured so that when the upper member is attached to the lower member, then the laterally extending holding fingers engage the notches in the leg side walls of the upper member to limit vertical movement of the upper member relative to the lower member and portions of the legs are received in the sockets, said sockets being engageable with the legs in a manner for limiting lateral movement of the upper member relative to the lower member when the legs are received in the sockets.

20. A pallet as set forth in claim 19 wherein said notches define openings through the leg side walls, said holding fingers being configured so that portions thereof extend into said openings when the upper member is attached to the lower member.

21. A pallet as set forth in claim 19 wherein said legs and holding fingers are configured for a snap engagement of the holding fingers with the notches in the leg side walls.

22. A pallet as set forth in claim 19 wherein the base, protrusions and fingers comprise a first single unitary piece, and wherein the deck and the legs comprise a second single unitary piece.

23. A pallet as set forth in claim 19 wherein the legs are generally hollow and taper downwardly from the deck of the upper member so that the legs of the upper member are nestable with legs of another member identical to the upper member when the lower member is not connected to the upper member.

* * * * *